US006279661B1

(12) United States Patent
Matherne, Jr.

(10) Patent No.: US 6,279,661 B1
(45) Date of Patent: Aug. 28, 2001

(54) PAD EYE

(76) Inventor: Lee Matherne, Jr., 107 Westfield, Lafayette, LA (US) 70503

( * ) Notice: Subject to any disclaimer, the term of this patent is extended or adjusted under 35 U.S.C. 154(b) by 0 days.

(21) Appl. No.: 09/541,556

(22) Filed: Apr. 3, 2000

(51) Int. Cl.[7] ..... E21B 19/16
(52) U.S. Cl. ..... 166/339; 166/242.1; 138/103
(58) Field of Search ..... 166/242.1, 242.6, 166/243, 345, 348, 343, 339; 138/103, 107

(56) References Cited

U.S. PATENT DOCUMENTS 3,751,932 * 8/1973 Mathews, Jr. ..... 405/173
4,710,061 * 12/1987 Blair et al. ..... 405/195.1
4,919,210 * 4/1990 Schaefer, Jr. ..... 166/356
5,148,871 * 9/1992 Gullion ..... 166/345
5,392,861 * 2/1995 Champagne ..... 166/379
5,706,863 1/1998 Matherne et al. .

* cited by examiner

*Primary Examiner*—Frank S. Tsay

(57) ABSTRACT

The pad eye hole for the pin of a lifting bail, or clevis, has two different radii producing hole profiles that overlap to provide one larger hole. One radius is the same as the radius of the pin and arranged to wrap almost half of the pin circumference when it is thrust against the hole wall for lifting. An alternate form of the pin hole is egg shaped with the smaller radius equal to that of the pin but wrapping somewhat less of the pin circumference. The resulting hole will accept a somewhat misaligned pin but win closely engage the pin load bearing surface while lifting loads.

7 Claims, 1 Drawing Sheet

OLD ART

OLD ART

PAD EYE

This invention pertains to pierced plates called pad eyes which are normally welded to tubular goods used in earth bore holes, and other structural members, handled by lifting apparatus.

BACKGROUND

Pad eyes are normally attached by welding to at least one end of tubular goods. At least two pad eyes are used diametrically opposite, within several inches of the end of the tube. After they have served the intended function, the pad eyes are often cut away. The pad eyes are critical elements in that they may temporarily support a full length of well bore related pipe. Their strength is a matter of concern and they are usually certified capable of the load expected.

When in the vertical position the load is usually supported by a wire line, or bail, attached to the pad eye by a clevis and pin. The hole in the pad eye has to be somewhat larger than the pin to enable the pin to be inserted without much time loss. A pin in an oversize hole, when lifting along a vector transverse to the pin axis, engages the hole wall along a line. At the line the unit loads are often very high and exceed the yield strength of the pad eye material. Large loads deform the material until an area of engagement on the pin distributes the stress to an amount below the yield strength of the pad eye material. The pin is harder than the pad eye and deforms very little. A deformed pin could not be easily pulled back through the clevis eye.

A considerable amount of engineering goes into certification of the pad eye but little is known about the stress distribution in metal around a deformed hole. The deformed metal around a hole presents a complex mathematical shape relationship to the parent metal. Metal crack resistance is suspect in the presence of work hardening that attends deformation. The prospect of dropping a string of casing, tubing, or conductor pipe into a hole is a matter that few engineers can ignore. through the clevis and the pad eye hole. The holes are currently made larger than the pin to avoid loss of time in rigging up for lifting. Making the hole, in total, fit the pin is not practical but making it larger, for utility, gives rise to the problem presently addressed.

SUMMARY OF INVENTION

A pad eye is provided with an arc that corresponds to the radius of the clevis pin to be used. The arc wraps about half the periphery of the pin. A somewhat larger hole has a wall that intersects the wall of the arc such that the desired wrap of the arc is realized. The larger hole readily accepts the clevis pin, and lifting with the pin brings the pin into engagement with the arc wall. That arrangement can provide the largest load bearing contact with the pin that is achievable.

An arrangement somewhat less perfect in wrapping half the pin periphery, but still wrapping about eighty percent of half the pin periphery is accomplished with an egg shaped hole having the small end of the hole represent the radius of the pin. The egg shaped hole still engages the most effective area of the pin because the outer edges of an arc fitting the pin is nearly parallel to the lifting vector imposed on the pin and hole combination. The deformed area of a yielded surface on a pad eye is rarely as much as three fourths of the engageable half of the pin used. The egg shaped hole provides easy entry of the pin when installing the clevis. The egg shaped hole is an optional feature.

It is therefore an object of this invention to provide a pad eye with a hole that readily accepts the clevis pin but engages most of the pin compression, or lifting, surface when load is applied.

These and other objects, advantages, and features of this invention will be apparent to those skilled in the art from a consideration of this specification, including the attached claims and appended drawings.

BRIEF DESCRIPTION OF DRAWINGS

In the drawings wherein like features have similar captions.

DETAILED DESCRIPTION OF DRAWINGS

Figure 1A:
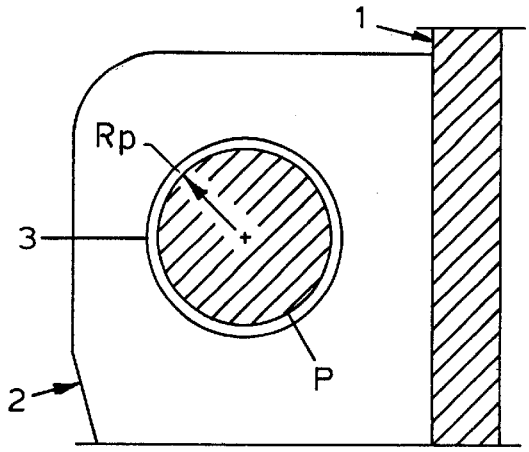
FIGS. 1A and 1B are representative of old art.

In the drawings, some details of construction that are well established in the art, and having no bearing upon points of novelty, are omitted in the interest of clarity of descriptive matter. Such details may include weld lines, and threaded fasteners.

Figure 1B:
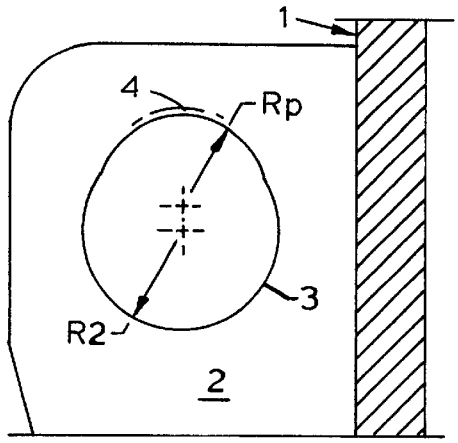

FIGS. 1A and 1B show old art. The pad eye 2 is welded to a tube 1, only one wall being shown. Pin hole 3 has to be larger than the pin P for installation (radius R2 larger than Rp). When the load is applied to lift a string of pipe, the load may be in the range of one-half million pounds. The pin deforms the material of the hole wall to conform to radius Rp, until the line contact first experienced is deformed to arcuate shape 4 to reduce the unit load to the yield stress of the pad eye material.

Figure 2:
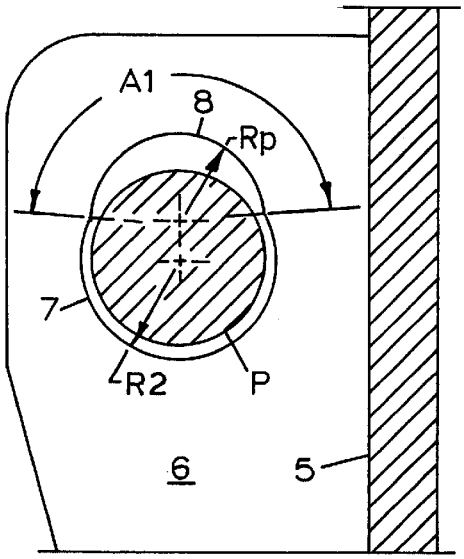
FIG. 2 is an elevation of one plane of the typical pad eye with the preferred pin hole.

FIG. 2 is an elevation of the preferred form of the invention. Pad eye 6 is welded to tube wall 5. The pin hole has two radii Rp and R2 producing peripheries 7 and 8 which intersect to provide for periphery 8 to wrap about half the circumference of a pin P with radius Rp. The lifting load then is applied to the pin over most of the area available for load bearing. The angle A1 can be as high as one-half circle. An angle A1 of only ninety degrees will engage over seventy percent of the projected pin diameter. An arc extending through angle A1 is readily machined to about one hundred degrees of periphery and pin P inserts as easily as through a single hole with radius R2, yet it still provides a close fit for nearly all the laterally loaded surface of the pin for lifting heavy loads.

Figure 3:
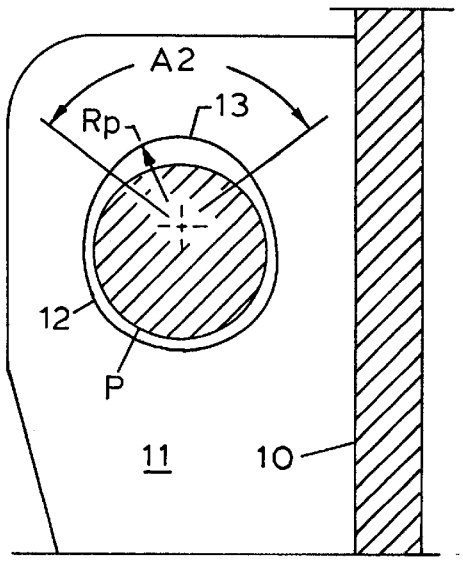
FIG. 3 is an elevation showing the alternate plan form of the invention.

FIG. 3 is an elevation of an alternate form of the invention. Pin hole 12 in pad eye plate 11 is egg shaped. The hole is designed for pin P and has a radius Rp to fit the pin and wrap it's pin fitting periphery 13 about an angle A2 of one hundred degrees. Excepting Rp the hole radius may vary over the balance of the periphery. Only the radius Rp bears load when lifting and the balance of the hole needs only clear the pin for ease of insertion therethrough. Severe changes in radius are avoided to reduce stress raising localities.

The plates 2, 6, and 11 are usually about the thickness of the wall of the tubes 1, 5, and 10 respectively.

From the foregoing, it will be seen that this invention is one well adapted to attain all of the ends and objects hereinabove set forth, together with other advantages which are obvious and which are inherent to the invention.

It will be understood that certain features and subcombinations are of utility and may be employed without reference to other features and sub-combinations. This is contemplated by and is within the scope of the claims.

As many possible embodiments may be made of the objects of this invention without departing from the scope thereof, it is to be understood that all matter herein set forth or shown in the accompanying drawings is to be interpreted as illustrative and not in a limiting sense.

The invention having been described, I claim:

1. A pad eye for attachment to structure to be lifted by hoisting means utilizing a pin through the eye, the pad eye comprising:

a) a plate for welding to said structure and having an upper end in the direction of intended lift; and b) a transverse hole through said plate shaped to clear said pin of a selected diameter by at least three one thousandth inch total, and having a selected portion of the hole periphery, generally centered about said direction, of the same radius as that of said selected diameter.

2. The pad eye of claim 1 wherein said selected portion provides an arcuate length of at least sixty degrees.

3. The pad eye of claim 1 wherein said hole comprises two radii, one radius being half said selected diameter, the other radius being at least two one-thousandths inch larger.

4. The pad eye of claim 1 wherein said hole is generally oval with said upper end comprising an arc of at least sixty degrees, and the balance of the hole having radii that change along the balance of the periphery to produce said generally oval form.

5. A pipe section with at least two pad eyes welded thereto extending radially from said pipe, said section comprising:

a) a section of pipe having an axis and an upper end;

b) at least two said pad eye plates each positioned to describe a vertical plane containing said axis, distributed about the periphery of said pipe and welded to said pipe near said upper end; and c) a transverse hole in each said plate having a selected amount of periphery on the upper side of said hole having the radius of a selected pin for lifting said section, the hole in general shaped to accept a pin at least three one thousandths inch larger in diameter than said selected pin.

6. The pad eye of claim 5 wherein said hole has two radii, a first radius being that of said selected pin. The second radius being at least two one thousandths of an inch larger than said first radius.

7. The pipe section of claim 5 wherein said hole is generally oval with said upper end comprising an arc of at least sixty degrees, and the balance of the hole having radii that change along the balance of the periphery to produce said generally oval form.

* * * * *